US010808479B2

(12) United States Patent
DiRocco

(10) Patent No.: US 10,808,479 B2
(45) Date of Patent: Oct. 20, 2020

(54) SETTING TOOL HAVING A BALL CARRYING ASSEMBLY

(71) Applicant: FORUM US, INC., Houston, TX (US)

(72) Inventor: Robert DiRocco, Humble, TX (US)

(73) Assignee: FORUM US, INC., Houston, TX (US)

( * ) Notice: Subject to any disclaimer, the term of this patent is extended or adjusted under 35 U.S.C. 154(b) by 176 days.

(21) Appl. No.: 16/119,456

(22) Filed: Aug. 31, 2018

(65) Prior Publication Data

US 2020/0072008 A1 Mar. 5, 2020

(51) Int. Cl.

| | |
|---|---|
| ***E21B 23/06*** | (2006.01) |
| ***E21B 33/13*** | (2006.01) |
| ***E21B 23/00*** | (2006.01) |
| ***E21B 33/10*** | (2006.01) |
| ***E21B 33/12*** | (2006.01) |
| ***E21B 33/134*** | (2006.01) |
| ***E21B 33/128*** | (2006.01) |
| ***E21B 33/129*** | (2006.01) |

(52) U.S. Cl.

CPC ..... *E21B 23/06* (2013.01); *E21B 23/00* (2013.01); *E21B 33/10* (2013.01); *E21B 33/12* (2013.01); *E21B 33/13* (2013.01); *E21B 33/134* (2013.01); *E21B 33/1204* (2013.01); *E21B 33/128* (2013.01); *E21B 33/129* (2013.01); *E21B 2200/04* (2020.05)

(58) Field of Classification Search

CPC ..... E21B 23/06; E21B 33/13; E21B 23/00; E21B 33/10; E21B 33/12; E21B 33/134; E21B 2034/002; E21B 33/129; E21B 33/1204; E21B 33/128

See application file for complete search history.

(56) References Cited

U.S. PATENT DOCUMENTS 2,230,712 A 2/1941 Bendeler et al.
2,737,244 A * 3/1956 Baker ..... E21B 23/06 166/124
2,799,343 A * 7/1957 Conrad ..... E21B 23/065 166/63

(Continued)

FOREIGN PATENT DOCUMENTS

WO 2016028311 A1 2/2016
WO 2016044597 A1 3/2016

(Continued)

OTHER PUBLICATIONS

International Search Report and Written Opinion dated Feb. 26, 2019, corresponding to Application No. PCT/US2018/060803.

(Continued)

*Primary Examiner* — David J Bagnell
*Assistant Examiner* — Jonathan Malikasim
(74) *Attorney, Agent, or Firm* — Patterson & Sheridan, L.L.P.

(57) ABSTRACT

A setting tool for setting a ball actuated device includes a ball carrying assembly. The ball carrying assembly includes a ball, an outer housing including an axis extending therethrough, and an inner housing positionable within the outer housing and configured to move axially along the axis with respect to the outer housing. The inner housing includes a recess formed therein to receive the ball therein, and the inner housing is releasably coupled to the ball actuated device.

27 Claims, 14 Drawing Sheets

(56) References Cited

U.S. PATENT DOCUMENTS

| | | | | |
|---|---|---|---|---|
| 3,343,607 | A | 9/1967 | Current | |
| 4,436,150 | A | 3/1984 | Barker | |
| 6,167,963 | B1 | 1/2001 | McMahan et al. | |
| 6,491,116 | B2 | 12/2002 | Berscheidt et al. | |
| 7,735,549 | B1 | 6/2010 | Nish et al. | |
| 7,740,079 | B2 | 6/2010 | Clayton et al. | |
| 8,079,413 | B2 | 12/2011 | Frazier | |
| 8,267,177 | B1 | 9/2012 | Vogel et al. | |
| 8,839,869 | B2 * | 9/2014 | Porter | E21B 33/128 166/181 |
| 9,169,704 | B2 | 10/2015 | Dockweiler et al. | |
| 9,759,034 | B2 | 9/2017 | King et al. | |
| 9,777,551 | B2 | 10/2017 | Davies et al. | |
| 9,835,003 | B2 | 12/2017 | Harris et al. | |
| 10,428,623 | B2 * | 10/2019 | Silva | E21B 41/00 |
| 2011/0240295 | A1 | 10/2011 | Porter et al. | |
| 2015/0010797 | A1 | 1/2015 | Kim | |
| 2015/0013965 | A1 | 1/2015 | Cox et al. | |
| 2015/0129242 | A1 | 5/2015 | Farquhar | |
| 2015/0300121 | A1 | 10/2015 | Xu | |
| 2016/0138387 | A1 | 5/2016 | Xu et al. | |
| 2016/0305215 | A1 | 10/2016 | Harris et al. | |
| 2016/0312555 | A1 | 10/2016 | Xu et al. | |
| 2016/0376869 | A1 | 12/2016 | Rochen et al. | |
| 2018/0266204 | A1 | 9/2018 | Sherlin | |

FOREIGN PATENT DOCUMENTS

| | | | |
|---|---|---|---|
| WO | 2016210161 | A1 | 12/2016 |
| WO | 2017044298 | A1 | 3/2017 |

OTHER PUBLICATIONS

International Search Report and Written Opinion dated May 28, 2019, corresponding to Application No. PCT/US2018/064973.

International Invitation to Pay Additional Fees dated Apr. 3, 2019, corresponding to Application No. PCT/US2018/064973.

* cited by examiner

SETTING TOOL HAVING A BALL CARRYING ASSEMBLY

BACKGROUND

Field

Embodiments of the present disclosure relate to setting tool having a ball carrying assembly configured to set a ball actuated device in a wellbore for the production of oil and gas.

Description of the Related Art

Some fracturing plugs or "frac plugs" are an example of a ball actuated device used within a wellbore that requires a ball to be dropped from the surface and into the well for use. The frac plug is designed to set, seal, and isolate inside a wellbore to divide a well into one or more zones. After the frac plug is positioned in place and set within the wellbore with a setting tool, the plug may be used as a one way valve that allows fluid flow in one direction and not the other. For example, the wellbore may hold higher pressure above the frac plug, but when the pressure is released, the wellbore returns to equilibrium. This involves having a ball dropped from the surface and into the well for the ball to be received by the frac plug. The ball engages a seat formed within the frac plug to form a seal against the seat. The seal prevents pressure or flow across the frac plug, such as from an upper or top end of the frac plug and out through a lower or bottom end of the frac plug. When pressure or flow is experienced in the opposite direction across the frac plug, the ball disengages from the seat to allow flow from the lower end of the frac plug out through the upper end of the frac plug.

The ball being dropped from the surface may encounter various obstructions within the wellbore that prevent the ball from being received by the frac plug. Further, depending on the wellbore conditions and how deep the frac plug is set within the wellbore, the ball may need to be pumped down the wellbore to be received by the frac plug. Therefore, there exists a need for new and/or improved frac plugs.

SUMMARY

Embodiments of the present disclosure relate to a ball carrying assembly that may be used within the production of oil and gas, and more particularly to a setting tool that includes a ball carrying assembly used within a well.

In one embodiment, a setting tool for setting a ball actuated device is disclosed. The setting tool includes a ball carrying assembly and a tension assembly coupled to the ball carrying assembly. The ball carrying assembly includes a ball, an outer housing including an axis extending therethrough, and an inner housing positionable within the outer housing and is movable axially along the axis with respect to the outer housing. The inner housing includes a recess formed therein that is able to receive the ball therein, and the inner housing releasably couples to the ball actuated device. The tension assembly includes an outer mandrel to couple to the outer housing, and an inner mandrel to couple to the inner housing. The inner mandrel is positionable within the outer mandrel and moves axially along the axis with respect to the outer mandrel.

In another embodiment, a setting tool for setting a ball actuated device is disclosed. The setting tool includes a ball, an outer housing including an axis extending therethrough, and an inner housing positionable within the outer housing and is movable axially along the axis with respect to the outer housing. The inner housing includes a recess formed therein that is able to receive the ball therein, and the inner housing releasably couples to the ball actuated device.

In another embodiment, a method of assembling a ball carrying assembly is disclosed. The method includes coupling a ball carrying assembly to a setting tool, positioning a ball within a recess of the ball carrying assembly, and releasably coupling a ball actuated device to the ball carrying assembly such that the ball positioned within the ball carrying assembly is positioned above a seat of the ball actuated device.

In another embodiment, a method of setting a ball actuated device is disclosed. The method includes lowering a ball actuated device into a wellbore with a ball carrying assembly comprising a ball received therein, setting the ball actuated device within the wellbore through the ball carrying assembly, releasing the ball carrying assembly from the ball actuated device, and removing the ball from the ball carrying assembly into the wellbore.

In yet another embodiment, a downhole assembly is disclosed. The downhole assembly includes a ball actuated device and a setting tool configured to releasably couple to the ball actuated device to set the ball actuated device. The setting tool includes a ball carrying assembly and a tension assembly coupled to the ball carrying assembly. The ball carrying assembly includes a ball, an outer housing including an axis extending therethrough, and an inner housing positionable within the outer housing and is movable axially along the axis with respect to the outer housing. The inner housing includes a recess formed therein that is able to receive the ball therein, and the inner housing releasably couples to the ball actuated device. The tension assembly includes an outer mandrel to couple to the outer housing, and an inner mandrel to couple to the inner housing. The inner mandrel is positionable within the outer mandrel and moves axially along the axis with respect to the outer mandrel.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the present disclosure relate to a setting tool for use with a ball actuated device, a method of assembly of a setting tool, and a method of setting a ball actuated device. The setting tool includes a ball carrying assembly and a tension assembly that may be coupled to each other, such as through an adapter coupler. The ball carrying assembly includes an outer housing and an inner housing with the inner housing axially movable with respect to the outer housing. The inner housing includes a recess that is used to receive a ball therein, and the inner housing releasably couples to the ball actuated device. The ball actuated device, in one embodiment, may be a frac plug.

After the inner housing has decoupled from the inner housing, such as after the ball actuated device is set within a wellbore, the ball received within the recess of the inner housing may be removed, such as by falling out of the recess or being forced out of the recess (e.g., through fluid pressure). The ball may then move past the inner housing, particularly as the inner housing is removed from out of the ball actuated device, for the ball to be received within a seat of the ball actuated device.

Figure 1:
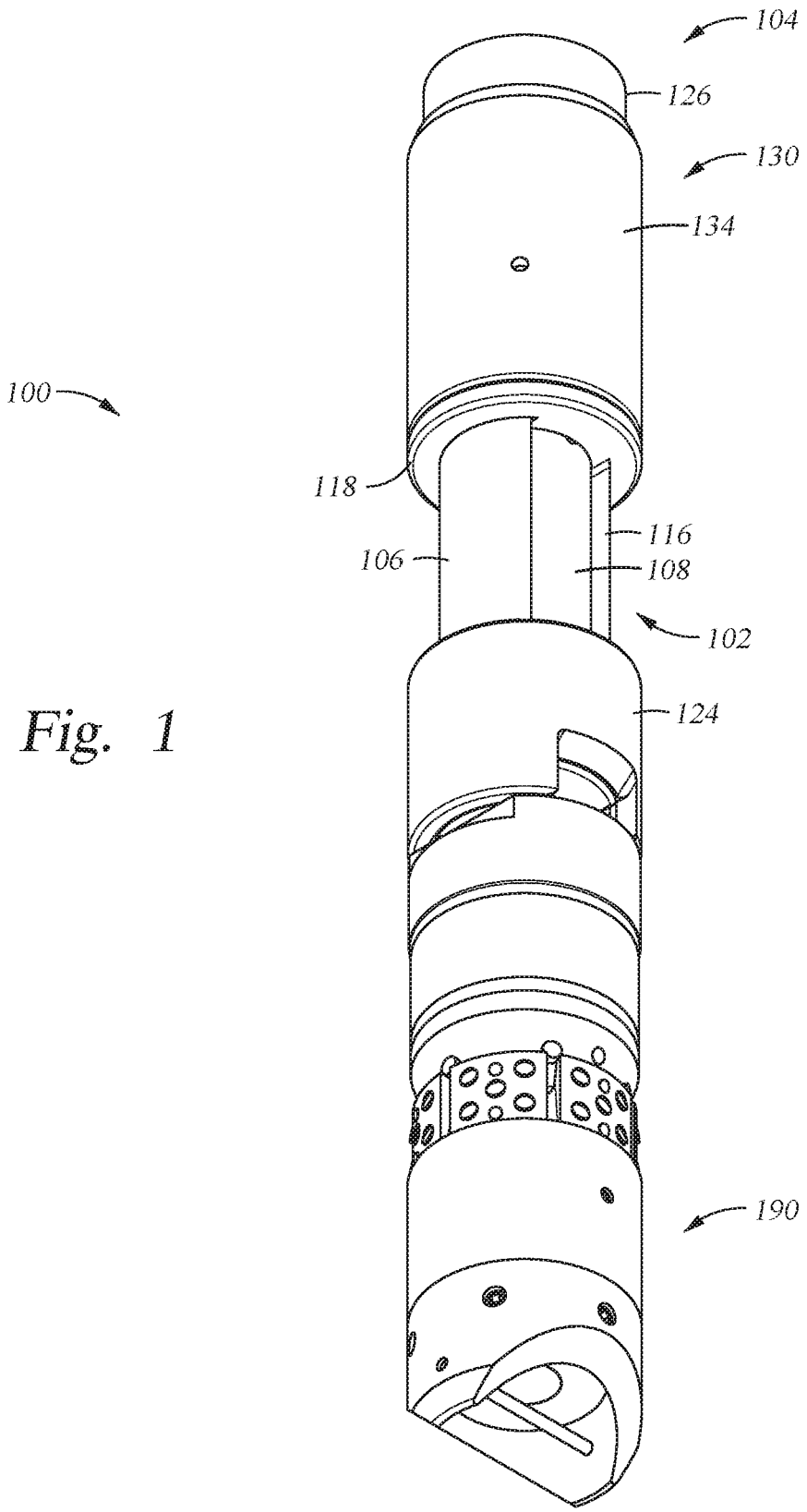
FIG. 1 is a below perspective view of a setting tool coupled to a ball actuated device in accordance with one or more embodiments of the present disclosure.
Figure 2:
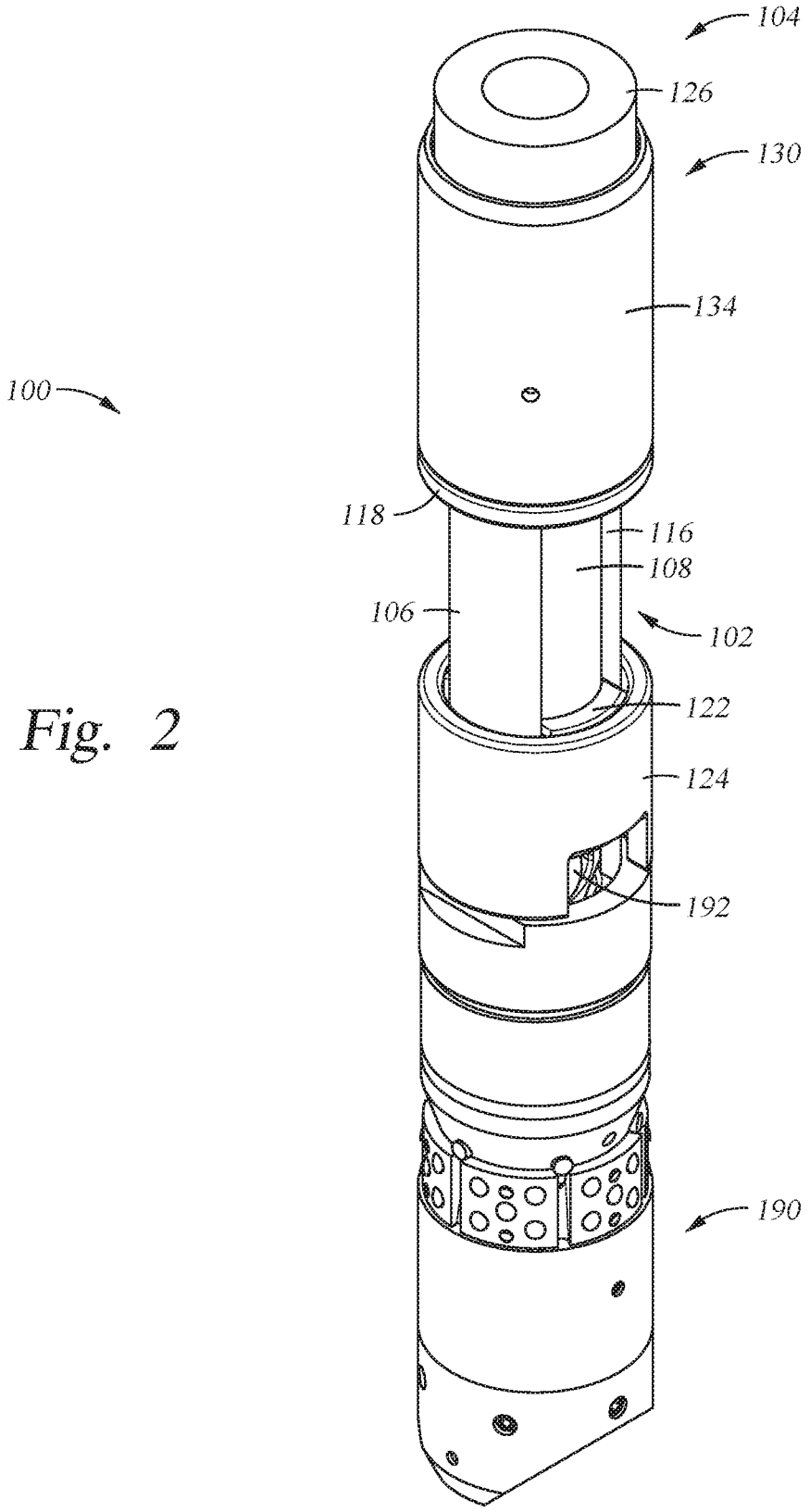
FIG. 2 is an above perspective view of the setting tool coupled to the ball actuated device in accordance with one or more embodiments of the present disclosure.
Figure 3:
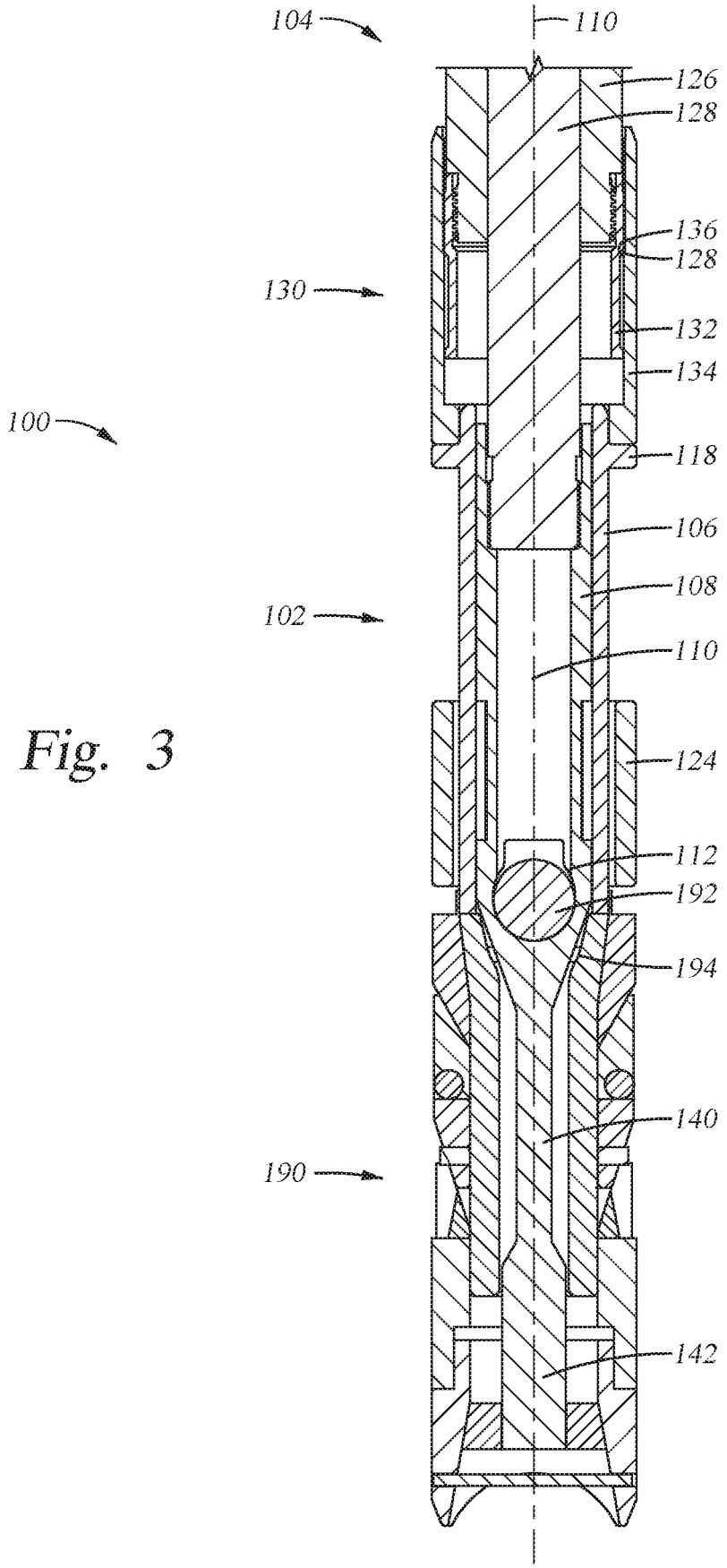
FIG. 3 is a cross-sectional view of the setting tool coupled to the ball actuated device in accordance with one or more embodiments of the present disclosure.
Figure 4:
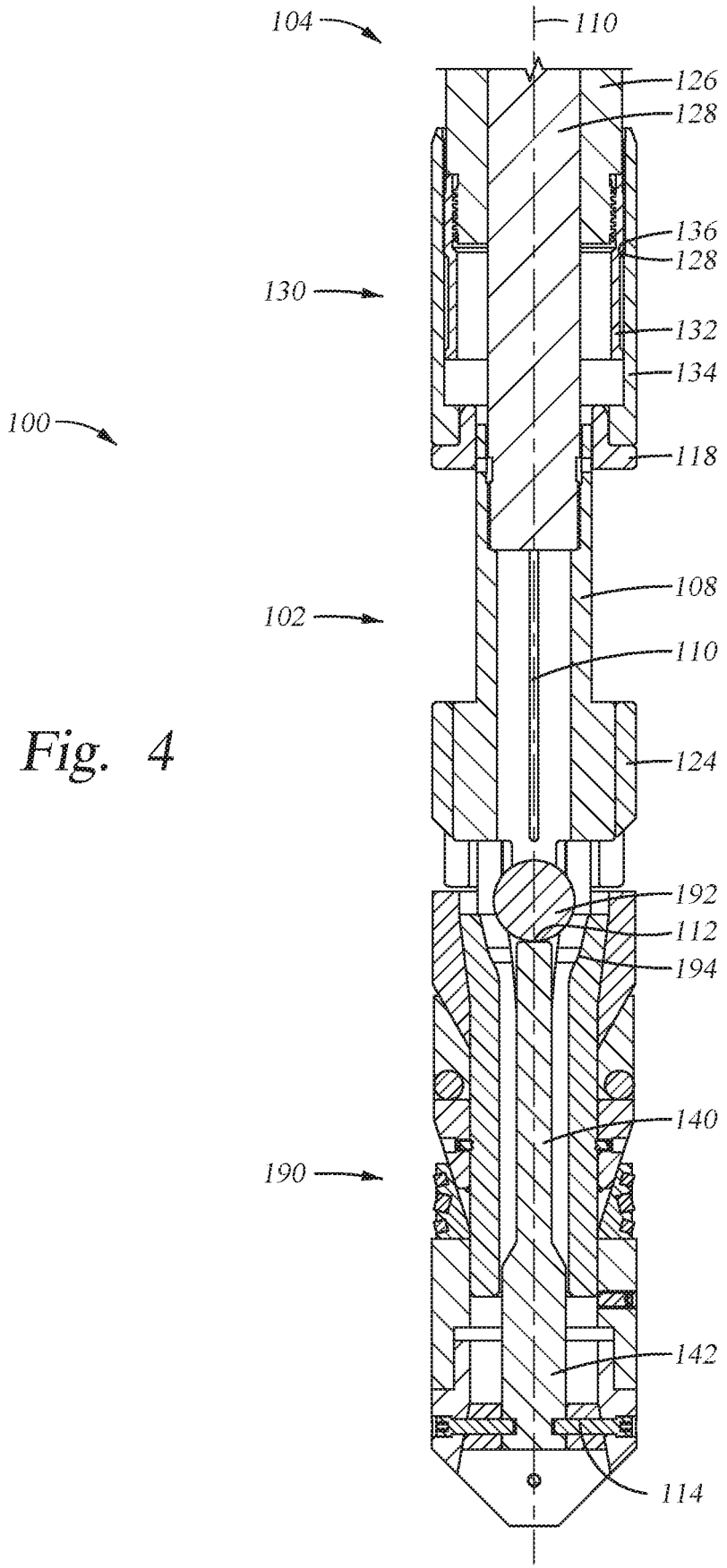
FIG. 4 is another cross-sectional view of the setting tool coupled to the ball actuated device rotated by ninety degrees with respect to the cross-sectional view in FIG. 3 in accordance with one or more embodiments of the present disclosure.
Figure 5:
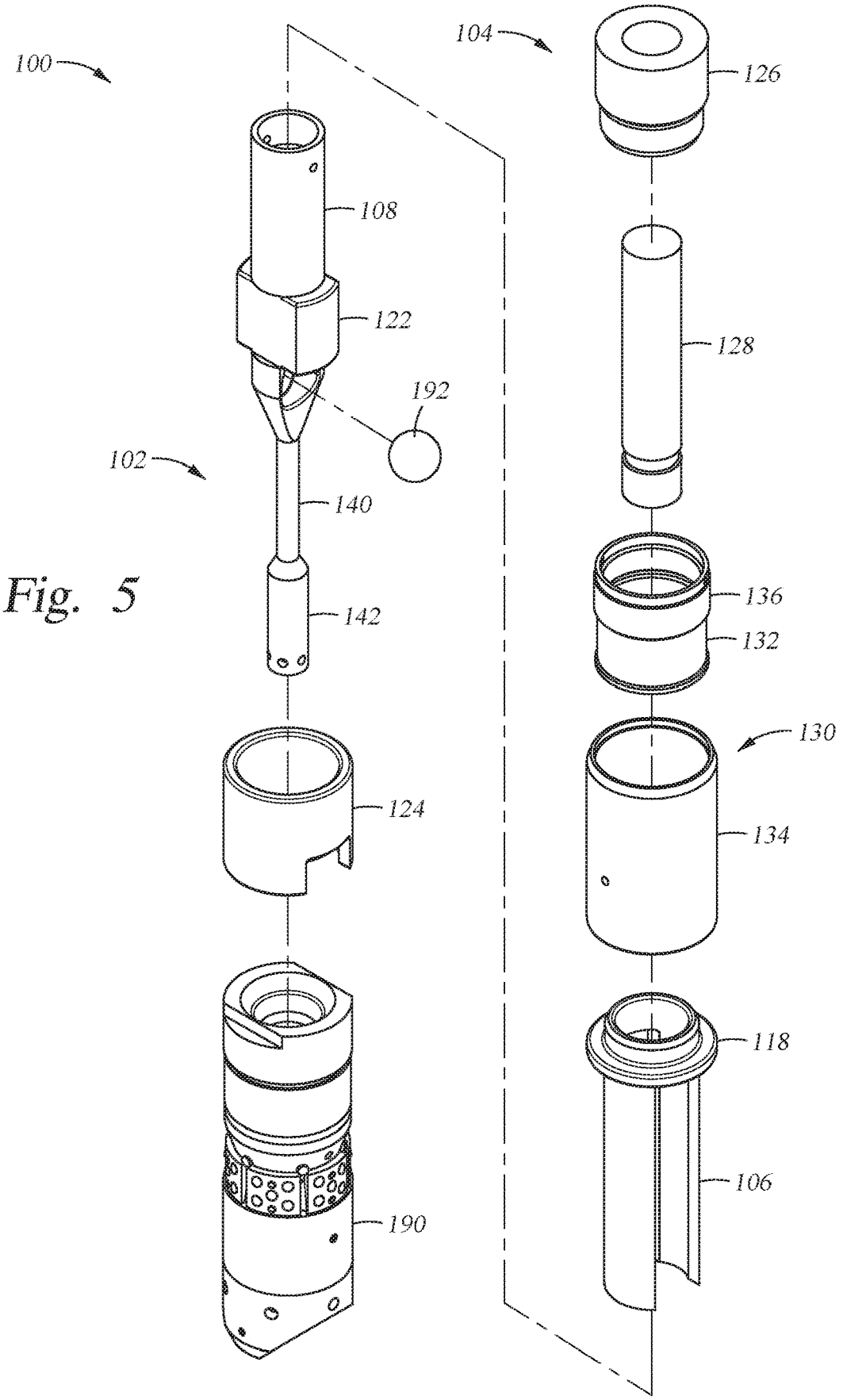
FIG. 5 is an exploded view of the setting tool in accordance with one or more embodiments of the present disclosure.
Figure 6:
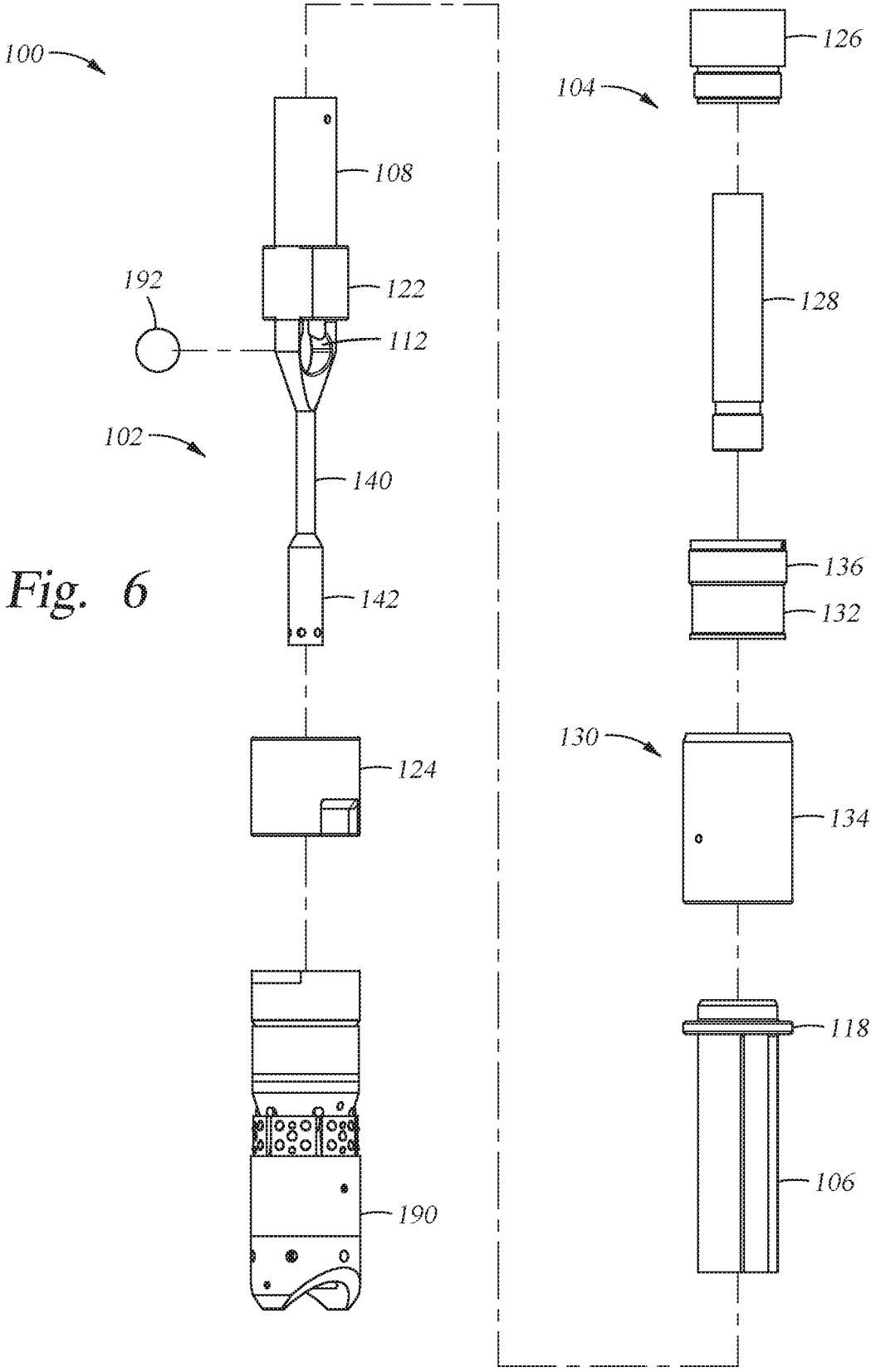
FIG. 6 is another exploded view of the setting tool rotated by forty-five degrees with respect to the exploded view of FIG. 5 in accordance with one or more embodiments of the present disclosure.
Figure 7:
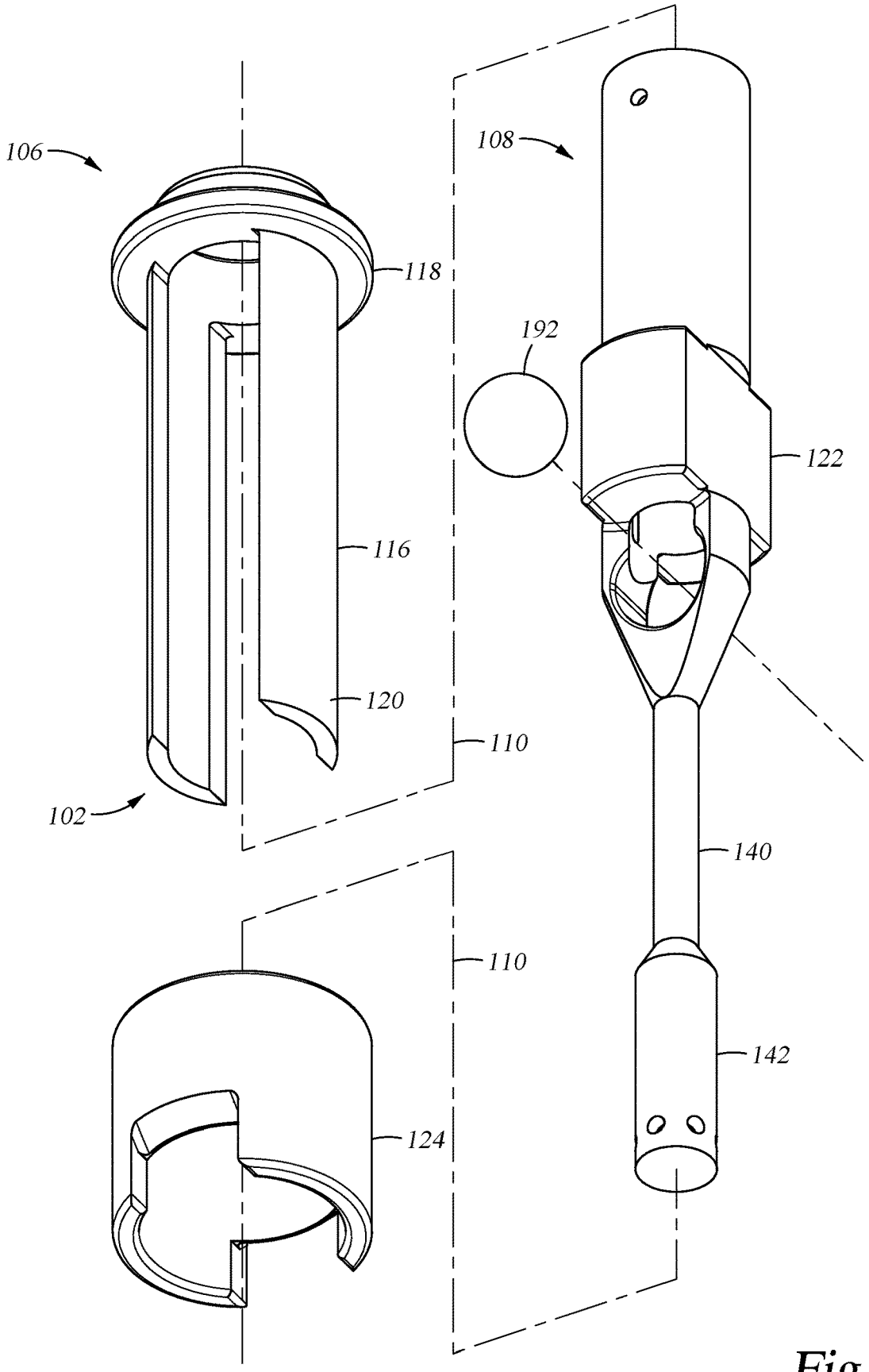
FIG. 7 is an exploded view of a ball carrying assembly of the setting tool in accordance with one or more embodiments of the present disclosure.

FIGS. 1-7 provide multiple views of a setting tool 100 for use with a ball actuated device 190 in accordance with one or more embodiments of the present disclosure. In particular, FIG. 1 is a below perspective view of the setting tool 100 coupled to the ball actuated device 190, FIG. 2 is an above perspective view of the setting tool 100 coupled to the ball actuated device 190, FIG. 3 is a cross-sectional view of the setting tool 100 coupled to the ball actuated device 190, and FIG. 4 is another cross-sectional view of the setting tool 100 coupled to the ball actuated device 190 rotated by ninety degrees with respect to the cross-sectional view in FIG. 3. Further, FIG. 5 is an exploded view of the setting tool 100, and FIG. 6 is another exploded view of the setting tool 100 rotated by forty-five degrees with respect to the exploded view of FIG. 5. Furthermore, FIG. 7 is an exploded view of a ball carrying assembly 102 of the setting tool 100.

The setting tool 100 is used to releasably couple to and set the ball actuated device 190. The ball actuated device 190, as shown, includes a frac plug, or may be any other ball actuated device known in the art, such as a packer, a stimulation tool, or other device. The setting tool 100 is used for positioning the ball actuated device 190 within a wellbore and setting the ball actuated device 190 within the wellbore, such as by applying a tension to the ball actuated device 190. Thus, in one or more embodiments, the setting tool 100, when in use with ball actuated device 190, may be referred to or used similarly as a downhole assembly or a bottom hole assembly.

After the ball actuated device 190 is set within the wellbore, the setting tool 100 releases from the ball actuated device 190, such as by shearing one or more shear screws used to releasably couple the setting tool 100 to the ball actuated device 190. A ball 192 carried by the ball carrying assembly 102 of the setting tool 100 is then removed from the ball carrying assembly 102 and received upon a seat 194 of the ball actuated device 190. The ball 192 may be received upon the seat 194 for the ball actuated device 190 to function within the wellbore, such as to selectively seal or isolate one or more portions of the wellbore with the ball actuated device 190.

As such, the setting tool 100 includes the ball carrying assembly 102 and a tension assembly 104 coupled to each other. The ball carrying assembly 102 includes an outer housing 106 and an inner housing 108 with an axis 110 extending through the ball carrying assembly 102. The inner housing 108 is positioned within the outer housing 106 and is movable with respect to the outer housing 106. In particular, the inner housing 108 is movable axially along the axis 110 with respect to the outer housing 106. The inner housing 108, thus, is movable from a lower position to an upper position with respect to the outer housing 106, discussed more below.

The inner housing 108 includes a recess 112 formed therein to receive the ball 192. The recess 112 is best shown in FIG. 7, in which the ball 192 is removably received (e.g., received into and removed from the recess 112). The ball 192 is carried by the ball carrying assembly 102 within the recess 112 when positioning the ball actuated device 190 within the wellbore with the setting tool 100. The inner housing 108 is also releasably coupled to the ball actuated device 190. For example, as best shown in FIG. 4, one or more shear screws 114 may be positioned between a lower end 142 of the inner housing 108 and the ball actuated device 190 to releasably couple the inner housing 108 to the ball actuated device 190. The inner housing 108 may be released and decoupled from the ball actuated device 190 then by shearing the shear screws 114.

Further, as best shown in FIG. 7, the outer housing 106 includes a shoulder 118 and one or more slots 116 (e.g., shown as substantially vertical slots) formed therein. The slots 116 extend through a bottom end 120 of the outer housing 106, such as by extending from the shoulder 118 through the bottom end 120. The slots 116, as shown, may be formed on opposite sides of the outer housing 106. Further, the inner housing 108 includes one or more shoulders 122, such as with a shoulder 122 corresponding to each slot 116. The shoulders 122 extend into and are movably positioned within the slots 116 such that the shoulders 122 are able to move along the slots 116 as the inner housing 108 moves axially with respect to the outer housing 106.

The engagement of the slots 116 and the shoulders 122 may be used to maintain a rotational position of the inner housing 108 with respect to the outer housing 106, such as when the inner housing 108 and the outer housing 106 move axially with respect to each other. The slots 116 also may enable the ball 192 to be removed from out of the outer housing 106 and the ball carrying assembly 102 altogether for being received into the ball actuated device 190. The inner housing 108 of the ball carrying assembly 102 may also have a reduced diameter portion 140, such as formed below the recess 112 and the shoulders 122 of the ball carrying assembly 102. The reduced diameter portion 140 may facilitate the ball 192 from passing by the inner housing 108 within the wellbore to be received by the seat 194 of the ball actuated device 190.

The ball carrying assembly 102 may further include a guide sleeve 124. The inner housing 108 and the outer housing 106 are positioned within the guide sleeve 124. The guide sleeve 124 is shown specifically positioned over the shoulders 122 of the inner housing 108. Further, the guide sleeve 124 is able to move axially along the axis 110 with respect to the outer housing 106. For example, the guide sleeve 124 is able to move with the inner housing 106 with respect to the outer housing 106. In one or more embodiments, the guide sleeve 124 may also be able to move axially along the axis 110 with respect to the inner housing 108.

As mentioned above, the setting tool 100 includes the ball carrying assembly 102 and the tension assembly 104 coupled to each other. The tension assembly 104 includes an outer mandrel 126 and an inner mandrel 128. The inner mandrel 128 is positioned within the outer mandrel 126 and is able to move axially along the axis 110 with respect to the outer mandrel 126. Further, the outer mandrel 126 couples to the outer housing 106, such as through an adapter coupler 130 discussed more below, and the inner mandrel 128 couples to the inner housing 108. Accordingly, the inner mandrel 128 is able to move from a lower position to an upper position with respect to the outer mandrel 126. As the outer mandrel 126 is coupled to the outer housing 106, and the inner mandrel 128 is coupled to the inner housing 108, the inner housing 108 moves axially with respect to the outer housing 106 as the inner mandrel 128 moves axially with respect to the outer mandrel 126.

Referring still to FIGS. 1-7, the setting tool 100 may include the adapter coupler 130 to couple the tension assembly 104 to the ball carrying assembly 102, and more particularly to couple the outer mandrel 126 to the outer housing 106. The adapter coupler 130 includes an inner sleeve 132 and an outer sleeve 134 with the outer mandrel 126 positioned within the adapter coupler 130. The inner sleeve 132 is positioned within the outer sleeve 134 such that a shoulder 136 of the inner sleeve 132 engages a recess 138 of the outer sleeve 134. The inner sleeve 132 and the outer sleeve 134 may additionally or alternatively threadedly engage with each other, such as through a threaded connection. Further, the inner sleeve 132 threadedly engages the outer mandrel 126, and the outer sleeve 134 engages (e.g., contacts) the shoulder 118 of the outer housing 106. The inner mandrel 128 is also shown positioned within and threadedly engaged to the inner housing 108. The arrangement and the coupling of the tension assembly 104 and the ball carrying assembly 102 may enable tension from the tension assembly 104 to be applied through the ball carrying assembly 102 and to the ball actuated device 190.

The present disclosure may relate to one or more methods of assembling the setting tool 100. In particular, the method may relate to coupling the tension assembly 104 to the ball carrying assembly 102, and/or coupling the setting tool 100 to the ball actuated device 190. The method includes coupling the adapter coupler 130 to the tension assembly 104. The adapter coupler 130 is coupled to the tension assembly 104 by coupling the inner sleeve 132 to the outer mandrel 126, such as by threadedly engaging the inner sleeve 132 with the outer mandrel 126. The outer sleeve 134 is then coupled to the inner sleeve 132, such as by threadedly engaging the outer sleeve 134 with the inner sleeve 132. In one embodiment, the outer sleeve 134 may be coupled to the inner sleeve 134 such that the shoulder 136 of the inner sleeve 132 engages the recess 138 of the outer sleeve 134.

The method further includes assembling the ball carrying assembly 102 by positioning the inner housing 108 within the outer housing 106. The shoulders 122 of the inner housing 108 are received within the slots 116 of the outer housing 106. The ball carrying assembly 102 is then coupled to the tension assembly 104. In particular, with the inner housing 108 positioned within the outer housing 106, the inner housing 108 is coupled to the inner mandrel 128, such as by threadedly engaging the inner housing 108 with the inner mandrel 128. The guide sleeve 124 may be positioned over the inner housing 108 and the outer housing 106 before or after the inner housing 108 is coupled to the inner mandrel 128.

The method continues by coupling the ball actuated device 190 to the ball carrying assembly 102. The ball 192 is inserted into the recess 112 of the inner housing 108, and the ball actuated device 190 is positioned over the lower end 142 of the inner housing 108. In such an embodiment, the ball 192 is positioned above the seat 194 of the ball actuated device 190. The inner housing 108 is then releasably coupled to the inner housing 108, such as by positioning (e.g., threadedly engaging) the shear screws 114 between the lower end 142 of the inner housing 108 and the ball actuated device 190. Further, in one or more embodiments, the outer housing 106 may be moved axially and lowered with respect to the inner housing 108 such that the lower end 120 of the outer housing 106 engages an upper end of the ball actuated device 190. Upon engagement of the outer housing 106 with the ball actuated device 190, the outer sleeve 134 may be moved axially and lowered with respect to the inner sleeve 132 (e.g., partially threadedly disengaged) such that the outer sleeve 134 engages the shoulder 118 of the outer housing 106.

Figure 8:
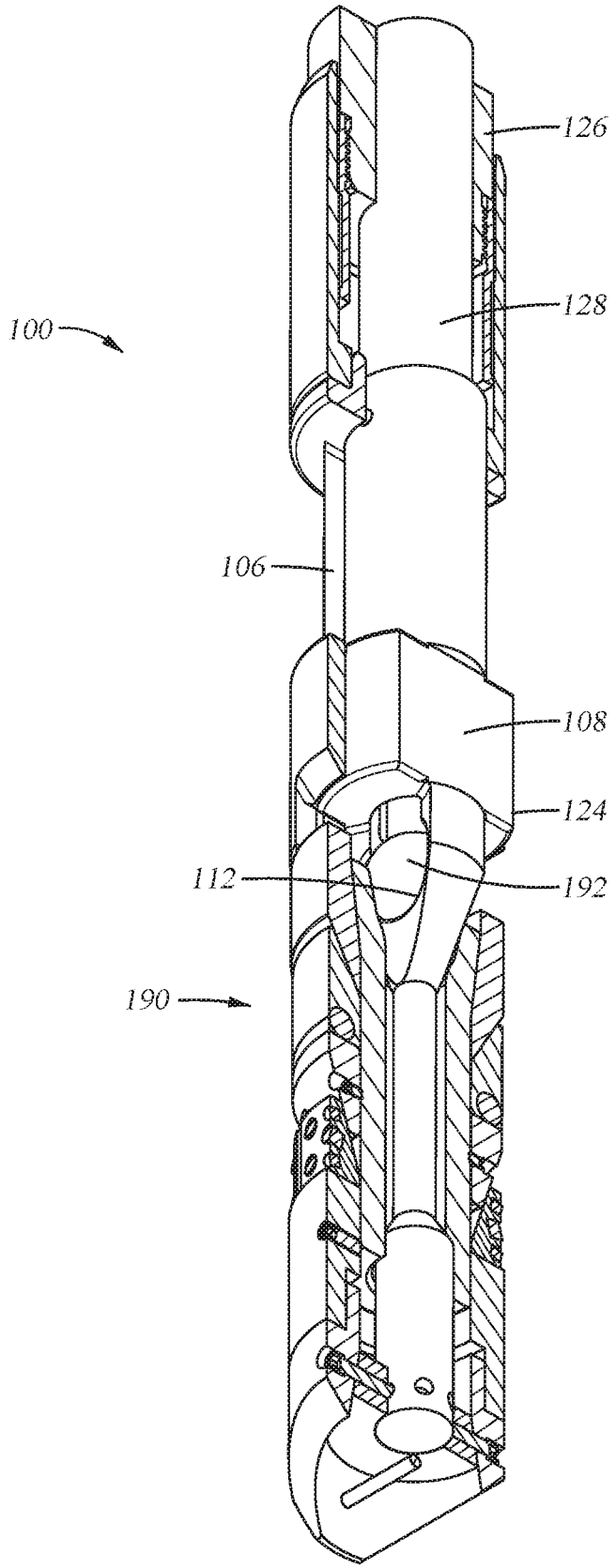
FIG. 8 shows the ball carrying assembly in a lower position in accordance with one or more embodiments of the present disclosure.
Figure 9:
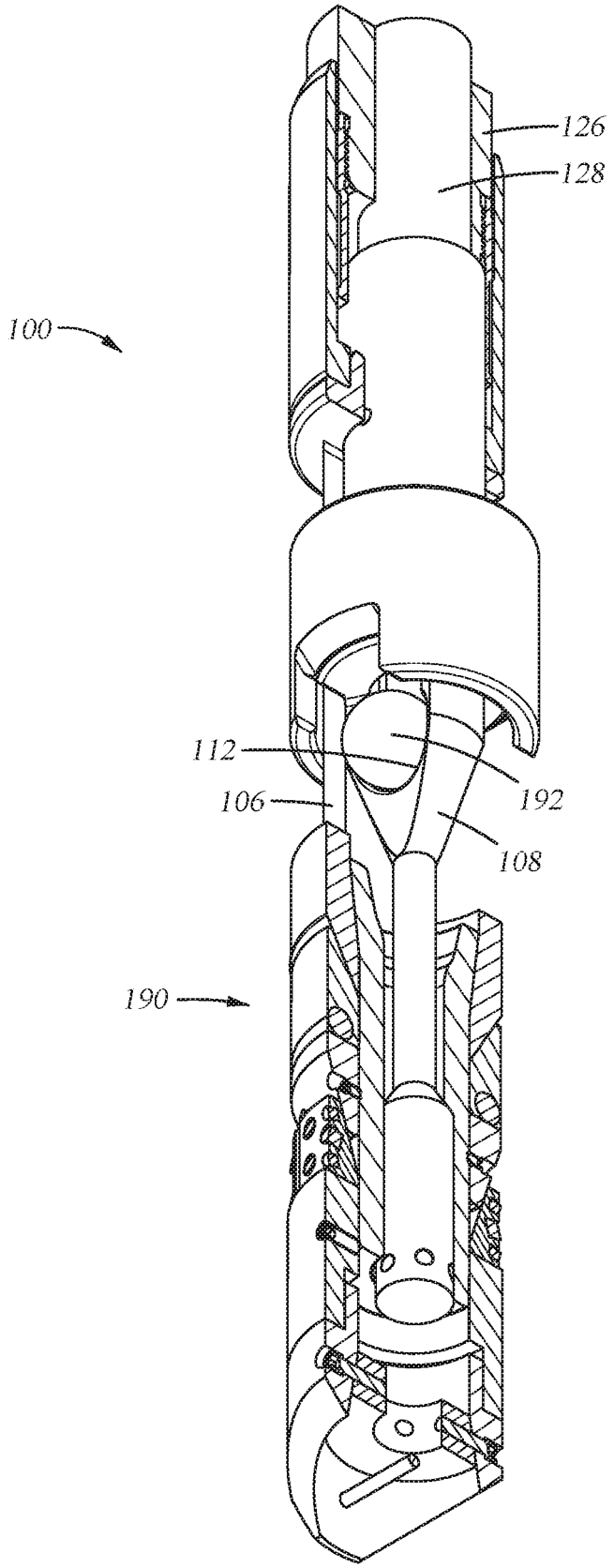
FIG. 9 shows the ball carrying assembly in an upper position in accordance with one or more embodiments of the present disclosure.

FIGS. 8 and 9 provide multiple sectional views of the setting tool 100 in use with the ball actuated device 190 in accordance with one or more embodiments of the present disclosure. In particular, FIG. 8 shows a sectional view of the inner housing 108 and the inner mandrel 128 in the lower position with respect to the outer housing 106 and the outer mandrel 126, respectively. FIG. 9 shows a sectional view of the inner housing 108 and the inner mandrel 128 in the upper position with respect to the outer housing 106 and the outer mandrel 126, respectively.

When in the lower position, the setting tool 100 may be used to position and set the ball actuated device 190 within the wellbore. For example, in the lower position in FIG. 8, as shown, the ball 192 is received within the recess 112 of the inner housing 108 and is prevented from substantially moving out of the recess 112. The inner housing 108 is also coupled to the ball actuated device 190. After the ball actuated device 190 within the wellbore is then set by the setting tool 100, the inner housing 108 and the inner mandrel 128 may then be moved from the lower position to the upper position. Once in the upper position, the ball 192 may be removed from the recess 112, as the ball 192 is shown as beginning to move out of the recess 112. Further, the inner housing 108 is decoupled from the ball actuated device 190. Thus, when in the lower position, the ball actuated device 190 may be in an unset position, and in the upper position, the ball actuated device 190 may be in a set position. When the ball actuated device 190 is in the set position, the ball actuated device 190 may grippingly engage a wall of the wellbore. Further, after the ball actuated device 190 is in the set position and the inner housing 108 is in the upper position, the ball 192 may be removed from the recess 112 of the inner housing 108 to be received within and engage the seat 194 of the ball actuated device 190.

Figure 10:
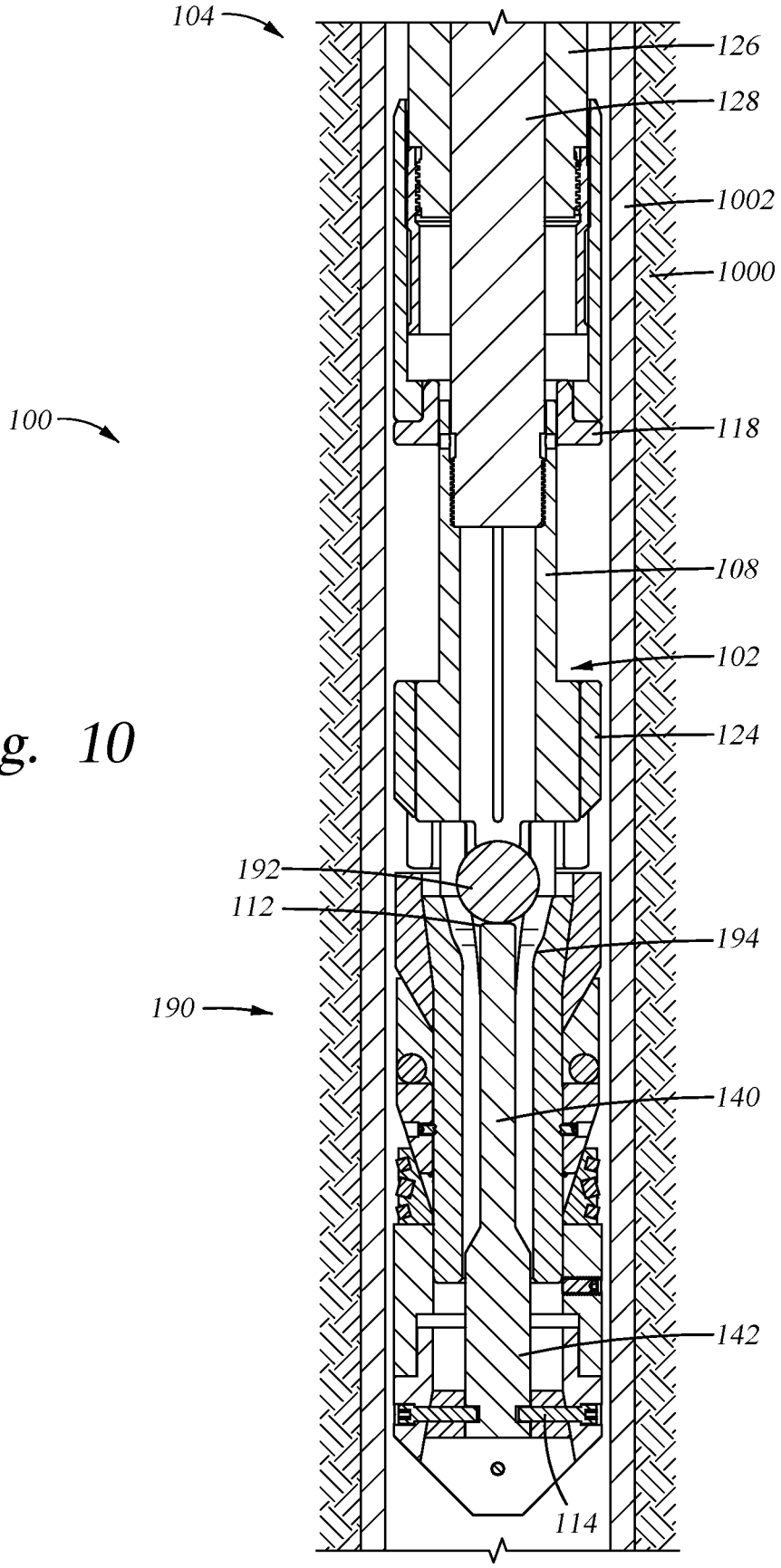
FIG. 10 shows a sectional view of the setting tool and the ball actuated device in a wellbore in an unset position in accordance with one or more embodiments of the present disclosure.
Figure 11:
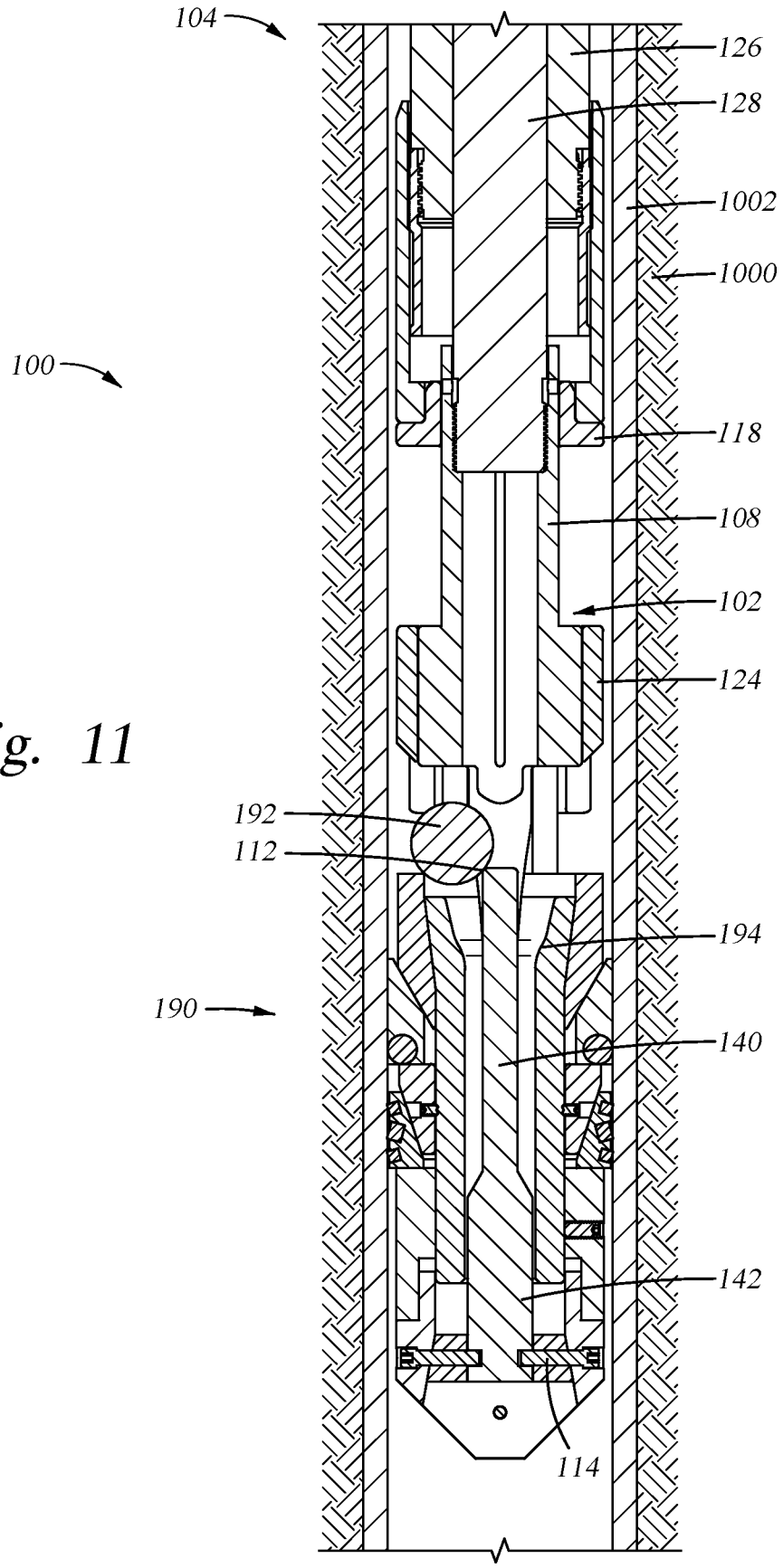
FIG. 11 shows a sectional view of the setting tool and the ball actuated device in the wellbore in a set position in accordance with one or more embodiments of the present disclosure.
Figure 12:
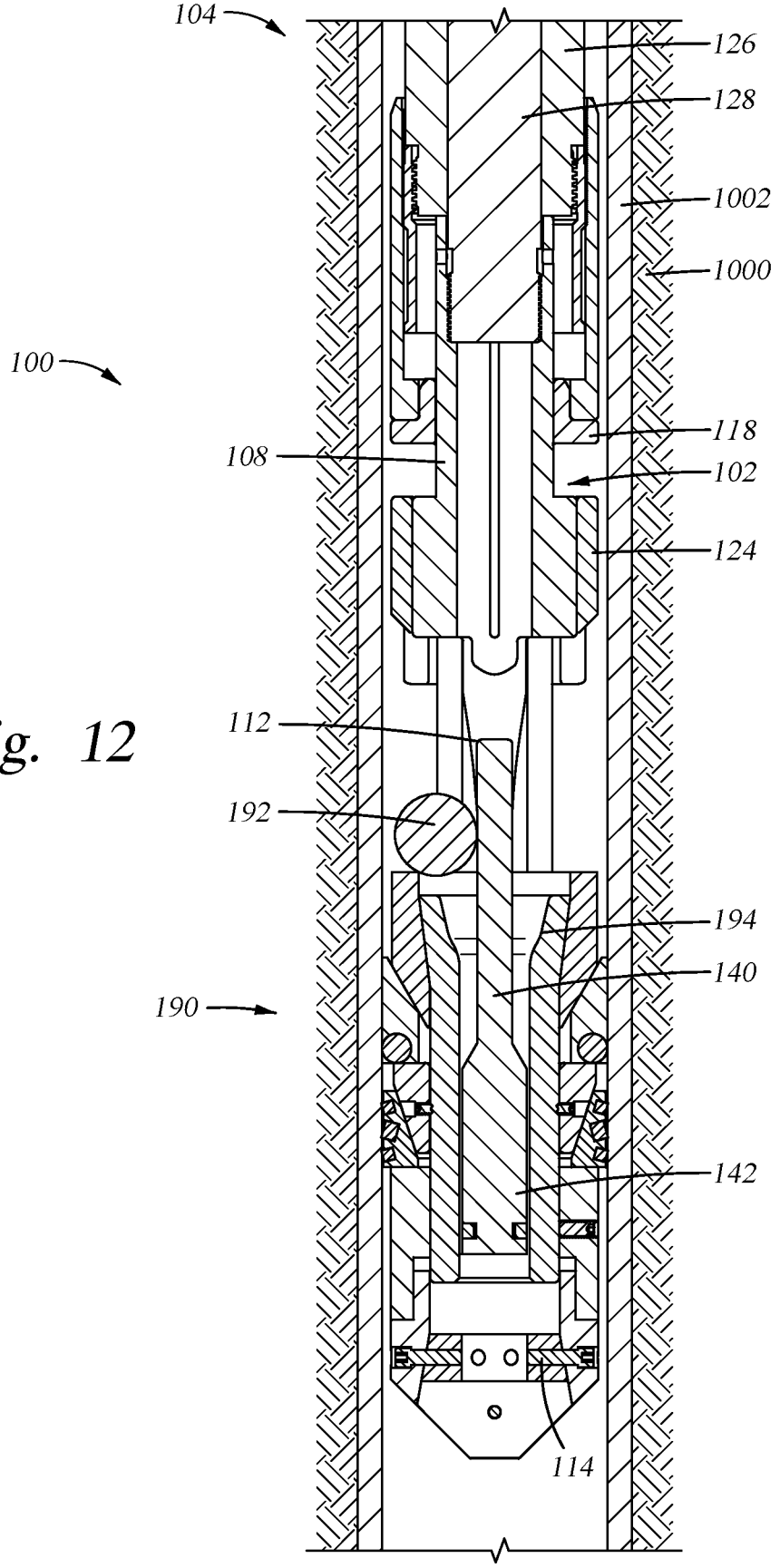
FIG. 12 shows a sectional view of the setting tool and the ball actuated device in the wellbore with the ball carrying assembly decoupled from the ball actuated device in accordance with one or more embodiments of the present disclosure.
Figure 13:
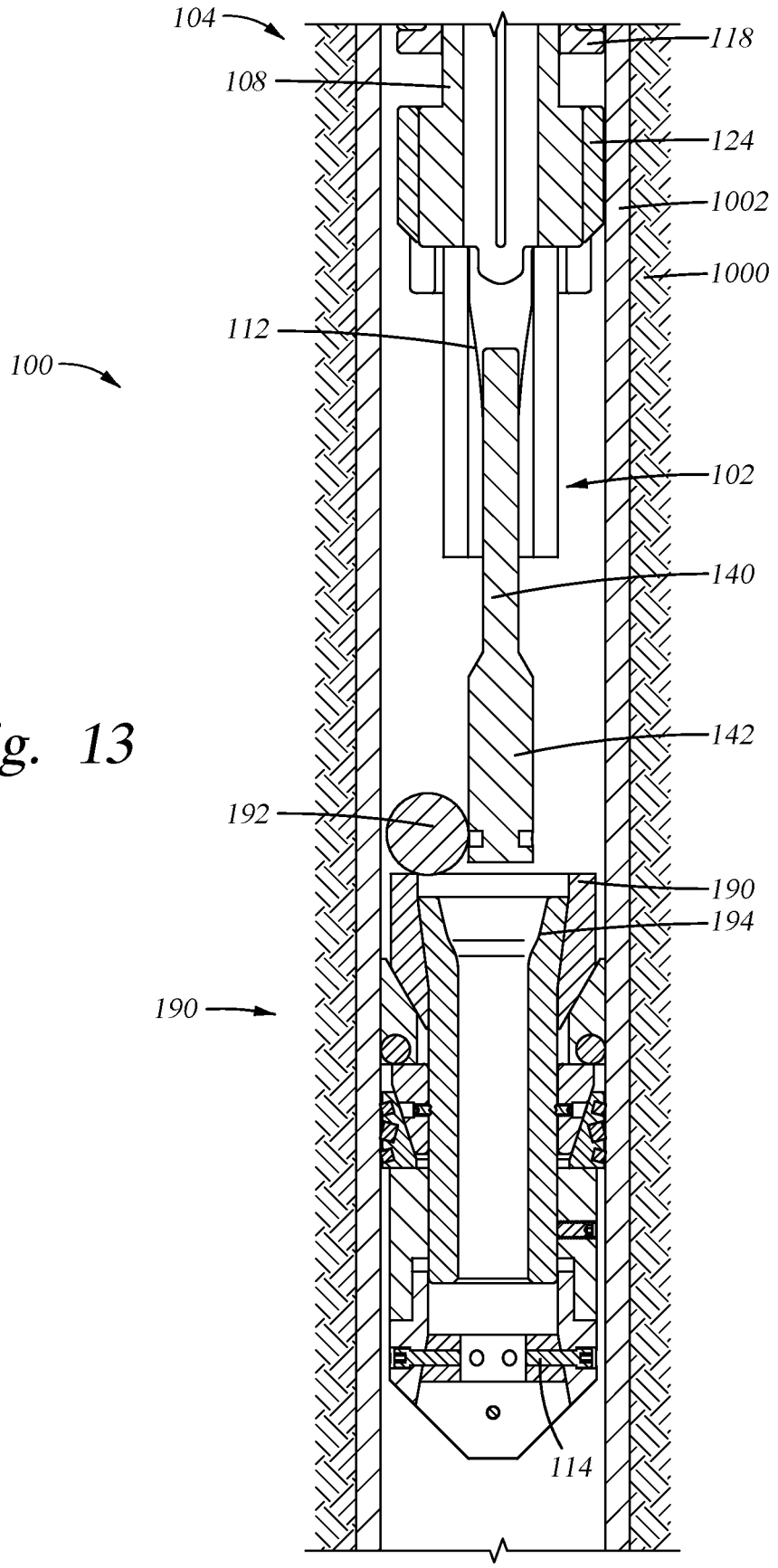
FIG. 13 shows a sectional view of the setting tool and the ball actuated device in the wellbore with the ball carrying assembly removed from the ball actuated device in accordance with one or more embodiments of the present disclosure.
Figure 14:
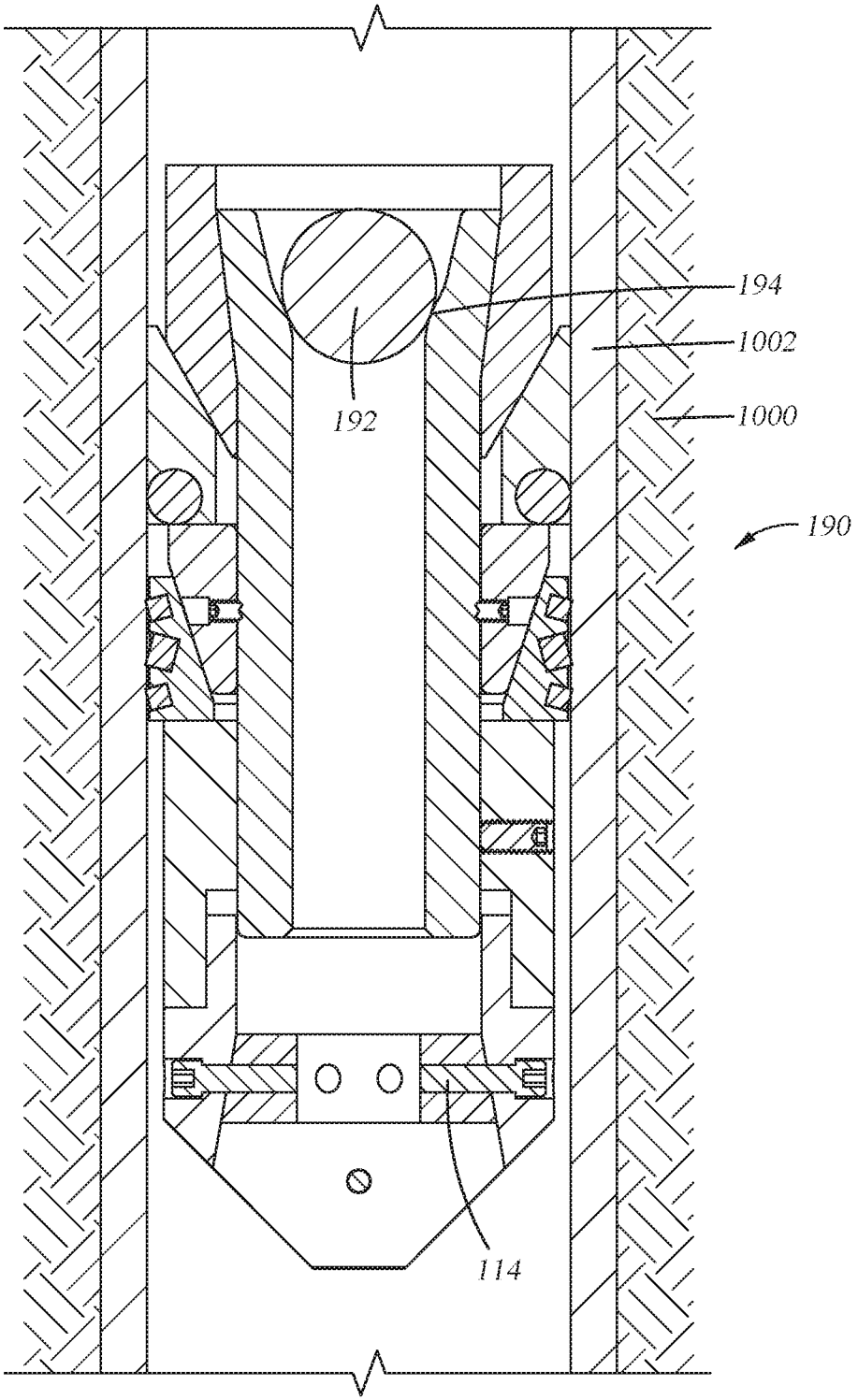
FIG. 14 shows a sectional view of a ball from the ball carrying assembly seated in the ball actuated device in accordance with one or more embodiments of the present disclosure.

FIGS. 10-14 provide multiple cross-sectional views of the setting tool 100 in a wellbore 1000 to set the ball actuated device 190 in accordance with one or more embodiments of the present disclosure. FIG. 10 shows the inner housing 108 in the lower position with respect to the outer housing 106 and the ball actuated device 190 in an unset position. FIG. 11 shows the inner housing 108 moving from the lower position to the upper position with respect to the outer housing 106 and the ball actuated device 190 in a set position. FIG. 12 shows the inner housing 108 in the upper position with respect to the outer housing 106 and ball carrying assembly 102 decoupled from the ball actuated device 190. FIG. 13 shows the ball carrying assembly 102 removed from the ball actuated device 190 with the ball 192 removed from the recess 112 of the inner housing 108 and within the wellbore 1000. FIG. 14 shows the ball 192 seated in the ball actuated device 190 when set in the wellbore 1000. Further, the wellbore 1000 in this embodiment is shown as including casing 1002, but the present disclosure is not so limited, as the wellbore 1000 may not include casing 1002 in another embodiment. The ball actuated device 190 is lowered with respect to the wellbore 1000 and moved from the unset to the set position to grip and/or form a seal against the casing 1002.

To move the ball actuated device 190 from the unset position to the set position, the setting tool 100 is used to apply tension or a lifting force to move the inner mandrel 128 upwards with respect to the outer mandrel 126. This translates to the tension or the lifting force applied through the ball carrying assembly 102 to move the inner housing 108 upwards with respect to the outer housing 106. Further, the inner housing 108 is releasably coupled to the ball actuated device 190, such as through the shear screws 114, and the lower end of the outer housing 106 engages the upper end of the ball actuated device 190.

The tension and the engagement between the ball carrying assembly 102 enables the inner housing 108 and the outer housing 106 to apply a compressive force across the ball actuated device 190. The tensile force, also referred to as a setting force, is able to move the ball actuated device 190 from the unset position, shown in FIG. 10, to the set position, shown in FIG. 11. In the set position, the ball actuated device 190 grips and/or seals against the casing 1002. The movement of the ball actuated device 190 from the unset position to the set position also enables the inner housing 108 to begin moving from the lower position towards the upper position.

Further application of tension from the setting tool 100 to the ball actuated device 190 may release the ball carrying assembly 102 from the ball actuated device 190. In particular, once a shear force is reached, which is higher than the setting force, the shear screws 114 positioned between the inner housing 108 and the ball actuated device 190 may shear to decouple and release the inner housing 108 from the ball actuated device 190. FIG. 12 shows the ball carrying assembly 102 released from the ball actuated device 190 with the inner housing 108 moved into the upper position within respect to the lower housing 106. The ball 192 has also now been removed from the recess 112 of the inner housing 108 and moved into the wellbore 1000. The ball 192, alternatively, may not move out yet of the recess 112, such as if not enough fluid pressure is present within the wellbore 1000 to disturb and remove the ball 192 from the recess 112.

FIG. 13 then shows the ball carrying assembly 102 removed from the ball actuated device 190, such as with the inner housing 108 fully removed from an interior of the ball actuated device 190. The setting tool 100 may be removed from the wellbore 1000 with the ball 192 removed from the recess 112 and remaining within the wellbore 1000. Thus, the ball carrying assembly 102, and particularly the reduced diameter portion 140 and the lower end 142 of the inner housing 108, pass by the ball 192 when being removed from the wellbore 1000. Further, to facilitate removal of the ball 192 from the recess 112, fluid, such as water, may be pumped into the wellbore 1000 to interact with the ball 192. The fluid may push and remove the ball 192 from the recess 112 and out of the ball carrying assembly 102. The ball 192, once in the wellbore 1000, may then fall or be pushed using fluid pressure to be received by the ball actuated device 190 to sealingly engage the seat 194 of the ball actuated device 190, as shown in FIG. 14.

The use of directional terms such as above, below, upper, lower, upward, downward, left, right, uphole, downhole and the like are used in relation to the illustrative embodiments as depicted in the figures, the upward direction being toward the top of the corresponding figure and the downward direction being toward the bottom of the corresponding figure, the uphole direction being toward the surface of the well and the downhole direction being toward the toe of the well.

While the foregoing is directed to embodiments of the present disclosure, other and further embodiments of the present disclosure thus may be devised without departing from the basic scope thereof, and the scope thereof is determined by the claims that follow.

The invention claimed is:

1. A setting tool for setting a ball actuated device, comprising:

a ball carrying assembly, comprising:

a ball;

an outer housing comprising an axis extending therethrough, the outer housing comprising a slot formed therein and extending through a bottom end of the outer housing; and an inner housing positionable within the outer housing and configured to move axially along the axis with respect to the outer housing, the inner housing comprising a recess formed therein that is configured to receive the ball therein, the inner housing configured to releasably couple to the ball actuated device, and the inner housing comprising a shoulder positionable within the slot and configured to move along the slot as the inner housing axially moves with respect to the outer housing; and a tension assembly configured to couple to the ball carrying assembly, comprising:

an outer mandrel configured to couple to the outer housing; and an inner mandrel configured to couple to the inner housing, wherein the inner mandrel is positionable within the outer mandrel and is configured to move axially along the axis with respect to the outer mandrel.

2. The setting tool of claim 1, wherein:

the inner housing comprises a reduced diameter portion positioned below the recess.

3. The setting tool of claim 1, further comprising an adapter coupler to couple the outer mandrel to the outer housing, the adapter coupler comprising an inner sleeve and an outer sleeve with the inner sleeve threadedly engaged with the outer mandrel and the outer sleeve engaged with a shoulder of the outer housing.

4. The setting tool of claim 1, wherein:

the inner housing comprises a reduced diameter portion positioned below the recess; and the inner housing is configured to releasably couple to the ball actuated device through a shear pin.

5. The setting tool of claim 1, wherein the ball actuated device comprises a frac plug.

6. A setting tool for setting a ball actuated device, comprising:

a ball carrying assembly comprising:

a ball;

an outer housing comprising an axis extending therethrough, the outer housing comprising a slot formed therein and extending through a bottom end of the outer housing; and an inner housing positionable within the outer housing and configured to move axially along the axis with respect to the outer housing, the inner housing comprising a recess formed therein that is configured to receive the ball therein, the inner housing configured to releasably couple to the ball actuated device, and the inner housing comprising a shoulder positionable within the slot and configured to move along the slot as the inner housing axially moves with respect to the outer housing.

7. The setting tool of claim 6, wherein:

the inner housing axially movable from a lower position to an upper position with respect to the outer housing;

in the lower position, the ball is received within the recess of the inner housing and the inner housing is coupled to the ball actuated device; and in the upper position, the ball is configured to be removed from the recess of the inner housing and the inner housing is decoupled from the ball actuated device.

8. The setting tool of claim 6, wherein the outer housing comprises an outer housing shoulder and the slot extends from the outer housing shoulder through the bottom end of the outer housing.

9. The setting tool of claim 6, further comprising a guide sleeve with the outer housing and the inner housing positionable within the guide sleeve.

10. The setting tool of claim 9, wherein:

the guide sleeve is configured to move axially along the axis with respect to the outer housing and the inner housing; and the guide sleeve is positionable over the shoulder of the inner housing.

11. The setting tool of claim 6, wherein:

the setting tool further comprises a tension assembly configured to couple to the ball carrying assembly; and the tension assembly comprises:

an outer mandrel configured to couple to the outer housing; and an inner mandrel configured to couple to the inner housing.

12. The setting tool of claim 11, wherein the inner mandrel is positionable within the outer mandrel and is configured to move axially along the axis with respect to the outer mandrel.

13. The setting tool of claim 11, wherein:

the outer mandrel is positioned within and coupled to the outer housing through an adapter coupler; and the inner mandrel is positioned within and threadedly engaged to the inner housing.

14. The setting tool of claim 13, wherein:

the adapter coupler comprises an inner sleeve positioned within an outer sleeve with a shoulder of the inner sleeve engaged with a recess of the outer sleeve;

the inner sleeve is threadedly engaged with the outer mandrel; and the outer sleeve is engaged with a shoulder of the outer housing.

15. The setting tool of claim 6, wherein the inner housing comprises a reduced diameter portion positioned below the recess.

16. The setting tool of claim 6, wherein the inner housing is configured to releasably couple to the ball actuated device through a shear pin.

17. The setting tool of claim 6, wherein the ball actuated device comprises a frac plug.

18. A method of assembling a ball carrying assembly, comprising:

coupling a ball carrying assembly to a setting tool, the ball carrying assembly comprising:

an outer housing comprising a slot formed therein and extending through a bottom end of the outer housing, and an inner housing comprising a shoulder positionable within the slot and configured to move along the slot as the inner housing axially moves with respect to the outer housing;

positioning a ball within a recess of the ball carrying assembly; and releasably coupling a ball actuated device to the ball carrying assembly such that the ball positioned within the ball carrying assembly is positioned above a seat of the ball actuated device.

19. The method of claim 18, wherein the releasably coupling the ball actuated device to the ball carrying assembly comprises using a shear screw to couple the ball actuated device to the ball carrying assembly.

20. The method of claim 18, wherein the coupling the ball carrying assembly to the setting tool comprises:

coupling an adapter coupler to an outer mandrel of the setting tool;

coupling the inner housing of the ball carrying assembly with an inner mandrel of the setting tool; and engaging the outer housing of the ball carrying assembly with the adapter coupler.

21. A method of setting a ball actuated device, comprising:

lowering a ball actuated device into a wellbore with a ball carrying assembly comprising a ball received therein, the ball carrying assembly comprising an inner housing and an outer housing;

setting the ball actuated device within the wellbore through the ball carrying assembly;

releasing the ball carrying assembly from the ball actuated device;

axially moving one or more shoulders of the inner housing along one or more slots of the outer housing, wherein the one or more slots of the outer housing extend through a bottom end of the outer housing; and removing the ball from the ball carrying assembly into the wellbore.

22. The method of claim 21, further comprising:

receiving the ball within a seat of the ball actuated device; and removing the ball carrying assembly from the wellbore.

23. The method of claim 21, wherein removing the ball from the ball carrying assembly comprises pumping fluid into the wellbore such that the ball is removed from the ball carrying assembly.

24. A downhole assembly, comprising:

a ball actuated device; and a setting tool configured to releasably couple to the ball actuated device to set the ball actuated device, the setting tool comprising:

a ball carrying assembly, comprising:

a ball;

an outer housing comprising an axis extending therethrough, the outer housing comprising a slot formed therein and extending through a bottom end of the outer housing; and an inner housing positionable within the outer housing and configured to move axially along the axis with respect to the outer housing, the inner housing comprising a recess formed therein that is configured to receive the ball therein, the inner housing configured to releasably couple to the ball actuated device, and the inner housing comprising a shoulder positionable within the slot and configured to move along the slot as the inner housing axially moves with respect to the outer housing; and a tension assembly configured to couple to the ball carrying assembly, comprising:

an outer mandrel configured to couple to the outer housing; and an inner mandrel configured to couple to the inner housing, wherein the inner mandrel is positionable within the outer mandrel and is configured to move axially along the axis with respect to the outer mandrel.

25. A setting tool for setting a ball actuated device, comprising:

a ball carrying assembly, comprising:

a ball;

an outer housing comprising an axis extending therethrough; and an inner housing positionable within the outer housing and configured to move axially along the axis with respect to the outer housing, the inner housing comprising a recess formed therein that is configured to receive the ball therein, the inner housing configured to releasably couple to the ball actuated device; and a tension assembly configured to couple to the ball carrying assembly, comprising:

an outer mandrel configured to couple to the outer housing; and an inner mandrel configured to couple to the inner housing, wherein the inner mandrel is positionable within the outer mandrel and is configured to move axially along the axis with respect to the outer mandrel; and an adapter coupler to couple the outer mandrel to the outer housing, the adapter coupler comprising an inner sleeve and an outer sleeve with the inner sleeve threadedly engaged with the outer mandrel and the outer sleeve engaged with a shoulder of the outer housing.

26. A setting tool for setting a ball actuated device, comprising:

a ball carrying assembly comprising:

a ball;

an outer housing comprising an axis extending therethrough; and an inner housing positionable within the outer housing and configured to move axially along the axis with respect to the outer housing, the inner housing comprising a recess formed therein that is configured to receive the ball therein, the inner housing configured to releasably couple to the ball actuated device; and a tension assembly configured to couple to the ball carrying assembly, the tension assembly comprising:

an outer mandrel configured to couple to the outer housing, wherein the outer mandrel is positioned within and coupled to the outer housing through an adapter coupler, and an inner mandrel configured to couple to the inner housing, wherein the inner mandrel is positioned within and threadedly engaged to the inner housing.

27. The setting tool of claim 26, wherein:

the adapter coupler comprises an inner sleeve positioned within an outer sleeve with a shoulder of the inner sleeve engaged with a recess of the outer sleeve;

the inner sleeve is threadedly engaged with the outer mandrel; and the outer sleeve is engaged with a shoulder of the outer housing.

* * * * *